US009423126B1

(12) United States Patent
Archer et al.

(10) Patent No.: US 9,423,126 B1
(45) **Date of Patent: *Aug. 23, 2016**

(54) COMPUTER PROGRAM PRODUCT FOR REDUCING VOLATILE ORGANIC COMPOUNDS FROM GASES WITH HYDROCARBONS

(71) Applicant: THE ARCHER COMPANY, INC, Stephenville, TX (US)

(72) Inventors: Lary D. Archer, Stephenville, TX (US); Kenneth Archer, Stephenville, TX (US)

(73) Assignee: THE ARCHER COMPANY, INC., Stephenville, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/859,157

(22) Filed: Sep. 18, 2015

Related U.S. Application Data

(63) Continuation-in-part of application No. 13/867,009, filed on Apr. 19, 2013, now Pat. No. 9,151,495.

(51) Int. Cl.

| | |
|---|---|
| ***F23N 5/02*** | (2006.01) |
| ***F23G 7/08*** | (2006.01) |
| ***F23N 1/00*** | (2006.01) |
| ***F23N 5/24*** | (2006.01) |
| ***F23J 15/02*** | (2006.01) |

(52) U.S. Cl.
CPC ..... *F23G 7/085* (2013.01); *F23J 15/02* (2013.01); *F23N 1/002* (2013.01); *F23N 5/242* (2013.01)

(58) Field of Classification Search
CPC ..... F23J 15/02; F23J 7/00; F23G 2200/00; G05B 15/02
USPC ..... 431/12, 5, 202, 2; 110/190, 225, 185; 73/863
See application file for complete search history.

(56) References Cited

U.S. PATENT DOCUMENTS

| | | | | |
|---|---|---|---|---|
| 5,425,316 | A | 6/1995 | Malone | |
| 6,012,917 | A * | 1/2000 | Wiseman | F23C 5/02 431/154 |
| 6,324,999 | B1 | 12/2001 | Maejima | |
| 6,485,292 | B1 | 11/2002 | Rhodes et al. | |
| 6,488,740 | B1 * | 12/2002 | Patel | B03C 3/16 95/71 |
| 6,863,875 | B1 | 3/2005 | Kotake et al. | |
| 6,955,042 | B1 | 10/2005 | Wnuck et al. | |

(Continued)

OTHER PUBLICATIONS

STIC Search—157Patents & 157NPL—DOCs Mar. 28, 2016.*

(Continued)

*Primary Examiner* — Gregory Huson
*Assistant Examiner* — Nikhil Mashruwala
(74) *Attorney, Agent, or Firm* — Buskop Law Group, PC; Wendy Buskop

(57) ABSTRACT

A computer program product to minimize the formation of volatile organic compounds by creating an emission control flare stack and informing users connected to a controller of the emission control flare stack, wherein the computer program product includes a library of preset limits, computer instructions to: (i) monitor inlet of gas and oxygen/air to a shell; (ii) control ignition of the gas forming an intermediate gas; (iii) control temperature of the intermediate gas, (iv) control neutralization of volatile organic compound components in the intermediate gas forming an emission within 40 CFR part 63, effective 2015, and (v) providing information to users via a network continuously on compliance, such as with an executive dashboard.

14 Claims, 5 Drawing Sheets

(56) References Cited

U.S. PATENT DOCUMENTS

| | | | | |
|---|---|---|---|---|
| 7,318,381 | B2 | 1/2008 | Arnold et al. | |
| 7,896,645 | B2 * | 3/2011 | Loving | F23C 3/002 110/210 |
| 8,629,313 | B2 * | 1/2014 | Hong | F23G 5/50 431/5 |
| 2004/0261673 | A1 * | 12/2004 | Allen | F23N 5/082 110/342 |
| 2006/0026017 | A1 * | 2/2006 | Walker | H04L 63/302 701/31.4 |
| 2007/0059653 | A1 * | 3/2007 | Purdy | F23G 7/08 431/5 |
| 2008/0087013 | A1 * | 4/2008 | Crawley | F01N 3/0231 60/320 |
| 2009/0178391 | A1 * | 7/2009 | Parrish | B01D 53/9495 60/286 |
| 2010/0229725 | A1 * | 9/2010 | Farsad | B01D 53/1456 96/74 |
| 2011/0116589 | A1 * | 5/2011 | Lustig | G01T 3/008 376/254 |
| 2011/0252137 | A1 | 10/2011 | Stienhans et al. | |

OTHER PUBLICATIONS

Environmental Protection Agency, Final Rule, 40 CFR Part 63, Oil and Natural Gas Section: New Source Performance Standards and National Emissions Standards for Hazardous Air Pollutants Reviews, 2012.

* cited by examiner

DISPLAY
CONTROLLER
FUEL SUPPLY
HEAT EXCHANGE FLUID
PUMP
NEUTRALIZATION SOLUTION PUMP
NEUTRALIZATION SOLUTION
1
8
10
11
12
13
14
15
16
18
20
22
23
24
26
27a
27p
28
30
31
32
33
34
35
36
50
52a
52f
60
62
64
66a
66b
66c
66d
68
72a
72b
72c
72d
74
80

COMPUTER PROGRAM PRODUCT FOR REDUCING VOLATILE ORGANIC COMPOUNDS FROM GASES WITH HYDROCARBONS

CROSS REFERENCE TO RELATED APPLICATION

The current application is a Continuation in Part of co-pending application Ser. No. 13/867,009 filed on Apr. 19, 2013, entitled "METHOD FOR REDUCING VOLATILE ORGANIC COMPOUNDS FROM GASES WITH HYDROCARBONS". This reference is incorporated herein in its entirety.

FIELD

The present embodiments generally relate to a computer program product for reducing volatile organic compounds from gas emissions into the atmosphere such as from well gases from oil wells and natural gas wells.

BACKGROUND

A need exists for a computer program product for reducing toxic emission from gases containing hydrocarbons using an emission control flare stack with a controller that controls burn, controls oxygenation, controls temperature and controls introduction of a neutralization solution.

A further need exists for a computer program product for decreasing greenhouse gases produced from well gases that is safe, efficient, and easy to use.

The present embodiments meet these needs.

BRIEF DESCRIPTION OF THE DRAWINGS

The detailed description will be better understood in conjunction with the accompanying drawings as follows.

Figure 1:
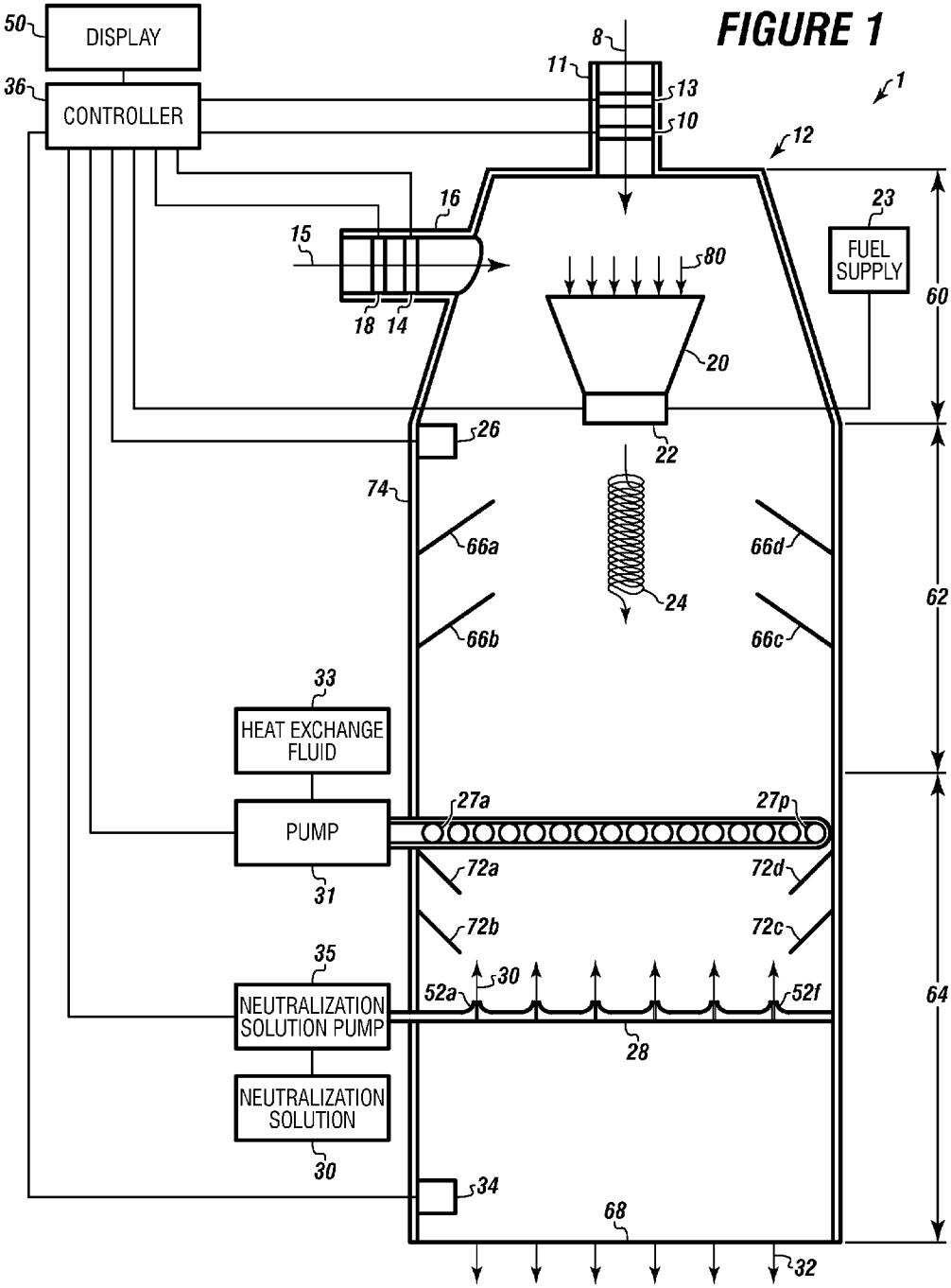
FIG. 1 is a side view of an emission control flare stack for reducing volatile organic compounds according to one or more embodiments.

The present embodiments are detailed below with reference to the listed Figures.

DETAILED DESCRIPTION OF THE EMBODIMENTS

Before explaining the present computer program product in detail, it is to be understood that the computer program product is not limited to the particular embodiments and that it can be practiced or carried out in various ways.

The embodiments generally relate to a computer program product to minimize the formation of volatile organic compounds by connecting to an emission control flare stack and informing users of the status of the emission control flare stack.

The computer program product can include a library of preset limits, computer instructions to: (i) monitor inlet of gas and oxygen/air to a shell; (ii) control ignition of the gas forming an intermediate gas; (iii) control temperature of the intermediate gas, (iv) control neutralization of volatile organic compound components in the intermediate gas forming an emission within 40 CFR part 63, effective 2015, and (v) providing information to users via a network continuously on compliance, such as with an executive dashboard.

The computer program product can assist in reducing volatile organic compounds from gases containing hydrocarbons, such as well gas, and preventing the volatile organic compound from entering the atmosphere such as for well gases from a well site.

Embodiments of the computer program product can control an emission control flare stack with a burner for treating gases containing hydrocarbons that are released from drilling muds or otherwise at an oil well site or natural gas well site.

Embodiments of the computer program product can be used with controllers that run gas emission flares for storage vessels that contain greenhouse gases or natural gas.

It is known that well gas temperatures fluctuate wildly and the present computer program product can be designed to accommodate these wild temperature fluctuations.

The highly efficient computer program product, when connected to a emission control flare stack, can run the burner intermittently or continuously to remove volatile organic compounds from well gases or other gases containing hydrocarbons, and provide safer emissions to comply with the 2015 EPA regulation 40 CFR Part 63 [EPQ-HQ-OAR-2010-0505, FRI-RIN 2060 AP 76] on concentrations of volatile organic compound emissions.

Use of this computer program product with a reduced emission flare stack can help prevent well site operators from being jailed or fined due to lack of compliance with a new 2015 effective date EPA regulation. If a well site not in compliance, the well site could be shut down and the production of natural gas and oil, would drop, likely causing gasoline and natural gas prices to increase prices at the gas pump hurting consumers.

The computer program product to minimize volatile organic compound concentration could keep well site operators free of the large fines they would otherwise incur by exceeding known Environmental Protection Agency (EPA) regulations and would also provide accelerated response system, allowing users of the computer program product to respond in 25 percent less time than current system allow, while additionally providing continuous information on compliance with the EPA regulations 24 hours a day 7 days a week.

The computer program product that can control volatile organic compound emissions by maintaining automatically, the temperature of intermediate gases post ignition from a burner that burns incoming gas, such as well gas, while simultaneously and automatically temperature controlling the intermediate gas and simultaneously and automatically injecting a neutralization solution into the temperature controlled intermediate gas while simultaneously preventing explosions, preventing death and preventing widespread destruction when flares inadvertently ignite and explode intake gas which could have too much of a dangerous component.

The computer program product can automatically neutralize volatile organic compounds in the gas to bring volatile organic compound concentrations to within the EPA regulations effective in the year 2015.

This computer program product can be usable after separating gas from well fluids, to burn and treat gas automatically, such as well gas separated from drilling mud which is produced during a well drilling operation in the oil and gas industry.

This unique computer program product can not only automatically control burning of well gases or other intake gases, but can also automatically enable an operator to view the status of a flare and automatically enable a plurality of users to view the status of multiple flares for a well or for multiple wells or multiple storage units simultaneously. The computer program product can provide an executive dashboard enabling viewing of a field of emission control flare stacks simultaneously.

This unique computer program product can enable many companies to view their compliance with EPA regulations in real time and automatically with up to the minute updates on the status of volatile organic compound concentrations, and on emission control flare stack operational status, enabling better compliance for a well site, and a healthy atmosphere.

Embodiments of the computer program product can include computer instructions which enable controllers on an individual well site location to provide one or more alarms or messages not only to an onsite field supervisor but to other users of the computer program product connected to the controller through a network. The onsite field supervisor and the other users can view an executive dashboard of the emission control flare stack and on the gases coming into, being treated by and going out of the emission control flare stack on their personal client devices, enabling users remote to the site to take action if the computer program product indicates volatile organic compound concentration has exceeded a preset limit in the emissions.

The term "administrative server" as used herein can refer to a computer with a processor and data storage connected to a network.

The term "controller" as used herein can refer to a processor, connected to data storage having computer instructions in the data storage that can communicate to the sensors and device on the emission control flare stack. In one or more embodiments, the controller can be a computer.

The term "cloud computing processor with cloud data storage" as used herein can refer to a processor with data storage that can be in a cloud computing environment to which the controller can communicate via at least one network. The cloud computing processor with cloud data storage can store and process signals from the controller or directly from the various sensors on the flare stack, essentially replacing the controller function on the stack, and placing the computing solution in the computing cloud in an embodiment of the invention. The cloud computing processor with cloud data storage can be one or more computers connected in the computing cloud.

The term "data storage" refers to a non-transitory computer readable medium, such as a hard disk drive, solid state drive, flash drive, tape drive, and the like. The term "non-transitory computer readable medium" excludes any transitory signals but includes any non-transitory data storage circuitry, e.g., buffers, cache, and queues, within transceivers of transitory signals.

The term "executive dashboard" as used herein can refer to a presentation of emission control flare stack information created by a single controller connected to the emission control flare stack, or by an administrative server or by a cloud computing processor connected to the emission control flare stack using computer instructions for forming the presentation of information and communicating the presentation of information in real time, such as 24 hours a day, to one or more client devices via a network.

The term "igniter" as used herein can refer to a device in the burner of the flare stack that provides the fire that combusts some or most of the gas entering the emission control flare stack.

The term "network" as used herein can refer to a satellite network, a cellular network, the internet, a local area network, a similar communication network, or combinations thereof.

The term "shell" as used herein can refer to a substantially metal surrounding, such as an enclosure, that provides an inlet for the gas, an inlet for the oxygen/air, and contains a burner with an igniter, a temperature sensor, and supports heating and cooling tubes used to maintain the temperature of gas post burner referred to herein as "intermediate gas" and a neutralization solution regulator for controlled injection of a neutralizing solution into temperature controlled intermediate gas, and an emission sensor.

The term "user" as used herein can refer to persons or computers that connect to the network with one or more client devices to receive and monitor information from one or a plurality of one or more controllers connected to emission control flare stacks for controlling volatile organic compound formation and release.

It should be noted herein, that for the invention, each client device has a processor, data storage, and computer instructions that enable presentation of an executive dashboard of data from at least one emission control flare stack for reducing volatile organic compound. Similarly each client device has computer instructions enabling presentation of an executive dashboard showing a plurality of emission control flare stacks as describe herein. Each client device can have a display.

The term "well gas" as used herein can refer to gas coming from a well without intermediate treatment of the gas.

In embodiments, the controllers can be disposed on the individual rigs to transmit alarms or messages not only to the onsite field supervisor but to other users using an executive dashboard, enabling users to remote to a site to view compliance issues and take action if the computer program product indicates volatile organic compound concentration has exceeded a preset limit in the emissions.

Turning now to the Figures, FIG. 1 is a diagram of an emission control flare stack for reducing volatile organic compound concentration in emissions that can connect to a network and one or more client devices.

The emission control flare stack 1 for reducing volatile organic compound content can have a gas flow meter 10 for sensing flow rates of an inlet gas 8, which can be a well gas, which flows through an inlet gas intake 11 into a shell 12.

The gas flow meter 10 can be a Turbine Meter, T model made by Cameron International Corporation of Houston, Tex.

The flow rate of inlet gas into the emission control flare stack can range from 1 mcf to 10,000,000 mcf.

The inlet gas can contain various components, including methane and $CO_2$ which can be burned by a burner. The inlet gas can have at least one hydrocarbon. The inlet gas, in embodiments, can contain benzene and $NO_x$.

The inlet gas intake can be a tube, such as a pipe with a diameter from 1 inch to 4 inches. In embodiments the inlet gas intake can connect to a drill mud circulating system connected to a well.

The shell, which can be a metal surround, can have a length from 5 feet to 40 feet and an inner diameter ranging from 1 inch to 20 inches at a first end. At the first end, the shell can be a burner cone. At the opposite end of the shell, the diameter of the emission outlet 68 can be from 9 inches to 72 inches. The shell can be formed in three distinct segments.

The portion of the shell 12 that contains the gas intake and a burner can be a burner cone 60 in embodiments. The burner cone can have tapered sides, such as at angles from 1 degree to 45 degrees from a longitudinal axis. This Figure depicts an embodiment of the shell with a burner cone 60 that can be welded or otherwise fastened to a shell body 62. The shell body 62 can be cylindrical. The burner cone 60 can be tapered, and is depicted tapering away from the inlet gas intake 11. The burner cone can have an inner diameter that ranges from 2 inches in diameter to 10 inches in diameter on the inlet gas intake end. In embodiments, the burner cone can be a cylinder or another shape that can have a contained inlet gas intake. At the opposite, wider end of the burner cone the diameter can range from 6 inches to 48 inches.

Connected to the burner cone can be a shell body. The shell body 62 can have a constant diameter. The diameter of the shell body 62 can range from 6 inches to 48 inches.

Attached to the shell body can be a shell heating and cooling segment 64. The shell heating and cooling segment 64 is depicted as flaring away, increasing in diameter from the diameter of the shell body 62. The inner diameter of the shell heating and cooling segment 64 can range from 6 inches to 102 inches.

The three segments of the shell can be made from steel, aluminum alloys, or other metals. The three segments forming the shell can have a wall thickness ranging from 0.25 inches to 1 inch.

The emission control flare stack 1 can have an inlet gas regulator 13 for regulating flow of the inlet gas 8 flowing through the inlet gas intake 11. The inlet gas regulator 13 can be a back pressure valve made by Kimray, Inc. of Oklahoma City, Okla.

An oxygen/air flow meter 14 can be connected to the shell 12 at the oxygen/air intake 16. The oxygen/air flow meter 14 can be used for sensing flow rates of oxygen/air 15 flowing into an oxygen/air intake 16 and mixing into the inlet gas 8 in the shell 12. A usable oxygen/air flow meter 14 can be a flow analyzer made by Cameron International Corporation. One or more oxygen/air flow meters can connect to a controller.

An oxygen/air regulator 18 can be used for regulating flow of oxygen/air 15 through the oxygen/air intake 16. A turbine, such as those made by Quality Turbocharger Components of Houston, Tex., can be used as the oxygen/air regulator 18. One or more oxygen/air regulators can connect to a controller.

The flow rate of the oxygen/air 15 into the inlet gas in the shell can range from 1 cubic foot to 500 cubic feet per minute. The diameter of the oxygen/air intake 16 can range from 1 inch to 6 inches.

In the shell, after the gas containing at least one hydrocarbon mixes with the oxygen/air, a burner 20 with at least one igniter 22 can ignite to burn all or a portion of components in the gas mixture. The burner 20 can connect to a power supply or fuel supply 23 as well as a controller. A usable burner can be one such as those made by D.B.I. of Bastrop, Tex. Usable burners with igniters can produce heat from 600 degrees Fahrenheit to 1200 degrees Fahrenheit.

In the shell 12, after the oxygen/air 15 mixes with the inlet gas 8, a gas mixture 80 can be formed.

The controller 36 can connect to the oxygen/air regulator, the oxygen/air flow meter, and the burner. The controller can be used to cause the burner to ignite, burning components in the gas mixture forming an intermediate gas 24.

The burn at the igniter can be a continuous burn, or can be an intermittent burn depending on comparisons of data made by the controller using sensors and flow meters connected to the shell and computer instructions in the controller having tables or lists of preset limits for different blends of oxygen and inlet gas with at least one hydrocarbon.

A temperature sensor 26 in the shell 12 can be used for detecting temperature of the intermediate gas 24 and transmitting temperature information to the controller 36.

A usable temperature sensor can be a Murphy Temperature Switch made by DK Controls of Irving, Tex.

In an embodiment, ridges 66*a*-66*d* can be formed on the interior of the shell post burner at an angle to cause the intermediate gas 24 to form a vortex, that is, a swirling, helical mass of intermediate gas.

The ridges 66*a*-66*d* can be from 2 inches to 12 inches in height rising from an interior surface of the shell body 62. Each of the plurality of ridges can be oriented at an angle from 20 degrees to 80 degrees from the flow path of intermediate gas in the shell thereby creating a swirling, helical gas flow which ensures thorough mixing. Each ridge can be from 2 inches to 12 inches long. The ridges can be made from steel or another material that will not corrode easily in the presence of the hydrocarbon component.

From 4 to 32 ridges can be used in the shell body 62, such as from 10 to 20 ridges positioned equidistantly around the inner surface of the shell body.

The plurality of ridges 66*a*-66*d* can be formed in the shell to create a vortex of the intermediate gas 24 prior to introducing the intermediate gas to the plurality of heating and cooling tubes 27*a*-27*p*.

The portion of the shell 12 that contains the ridges, temperature sensor 26, and intermediate gas 24 can be the shell body 62 which can have a diameter from 6 inches to 48 inches larger than the diameter of the burner cone, for enhanced mixing, and for forming a more uniformly blended intermediate gas.

In some embodiments, the shell 12 can have the same diameter as the exit end of the burner cone.

The shell 12 can have a shell heating and cooling segment 64 which has the emission outlet 68. A plurality of cooling and heating tubes 27*a*-27*p* can be positioned around the shell in the shell heating cooling segment on the inside of the shell.

In other embodiments, the heating and cooling tubes can be on the outside of the shell and on the inside of the shell.

The plurality of cooling and heating tubes in the shell are for regulating temperatures of the intermediate gas 24 to within preset limits that are determined using computer instructions in the controller and using sensor data collected from the flow meters and sensors on the shell.

The plurality of cooling and heating tubes can be substantially uniformly disposed around the shell for heating and cooling the intermediate gas 24, in an embodiment, and can provide a substantially increased surface area as compared to a flat surface. The heating and cooling tubes can be controlled with a fluid that is pumped into and out of the tubes from a heat pump with reservoir or similar control means. In an embodiment, from 10 cooling and heating tubes to 300 cooling and heating tubes can be used in the shell. In embodiments, each heating and cooling tube can have an inner diameter from 0.5 inches to 3 inches.

The Figure depicts that the heating and cooling tubes can receive a heat exchange fluid 33 that can be pumped using a pump 31 to and from the heating and cooling tubes.

In an embodiment, the shell heating and cooling segment 64 can have a larger diameter than the burner cone for enhanced mixing of the temperature controlled intermediate gas 24 as it contacts a neutralization solution 30 pumped from a neutralization solution pump 35 through a plurality of low pressure fluid injectors 52*a*-52*f* to mix with the intermediate gas 24 after being either heated or cooled, depending on the controller's computation of temperatures and volatile organic compound emission content by the heating and cooling tubes.

In embodiments the neutralization solution regulator can introduce the neutralization solution into the heated or cooled gas mixture after the gas contacts the heating and cooling tubes, using a residence time from 5 seconds to 60 seconds to form an emission with reduced volatile organic compound concentration.

In an embodiment, a layer of insulation 74 can be disposed at least partially around the shell, or in another embodiment, entirely around the shell.

In an embodiment, just prior to the neutralization solution regulator, a plurality of directional vanes 72*a*-72*d* can be installed to ensure the gas flows towards the nozzles of the neutralization solution regulator. Each directional vane can be oriented from 95 degrees to 180 degrees along the longitudinal axis of the gas flow path. Each vane can have a height of from 0.1 inch to 1 inch and a length of from 1 inch to 5 inches to improve concentration of the gas towards the neutralization solution. The vanes can be made form a non-corroding high temperature material in an embodiment.

In an embodiment, a neutralization solution regulator 28 can control introduction of a neutralization solution 30 into the intermediate gas 24.

A neutralization solution regulator 28 can be used with a plurality of low pressure fluid injectors 52*a*-52*f* for injecting a neutralization solution 30 into the intermediate mixture opposite a flow direction 54 of the intermediate solution to form an emission 32. In an embodiment, the neutralization solution can be ammonia, urea or combinations thereof. In embodiments, the neutralization solution can be a catalytic oxidative-reduction oxygen catalyst such as platinum supported, titanium supported, or rhodium supported catalyst.

In embodiments, the low pressure fluid injectors 52*a*-52*f* can disperse the neutralization solution as a mist with droplet sizes ranging from 1 micron to 5 microns. In embodiments, the low pressure fluid injectors 52*a*-52*f* can introduce the neutralization solution into the intermediate stream at a low pressure from 1 psi to 50 psi.

An emissions sensor 34 can be used for detecting volatile organic compound concentration in the emission 32 exiting the shell 12. The emission sensor can be connected to the controller 36. The emission sensor 34 can be a volatile organic compound sensor that is a volatile organic compound sensor made Neutronics, Inc. of Exton, Pa.

The emission sensor can transmit a detected volatile organic compound concentration to the controller 36. The controller 36 can include a processor in communication with a data storage and an optional display 50 can further communicate with a network. The display 50 can be used for viewing results and computation of the controller.

Also shown is a pump 31 for flowing heat exchange fluid 33 into and out of the plurality of heating and cooling tubes; and a neutralization solution pump 33 of the neutralization solution regulator 28 adapted for flowing neutralization solution 30 into the neutralization solution regulation.

Figure 2:
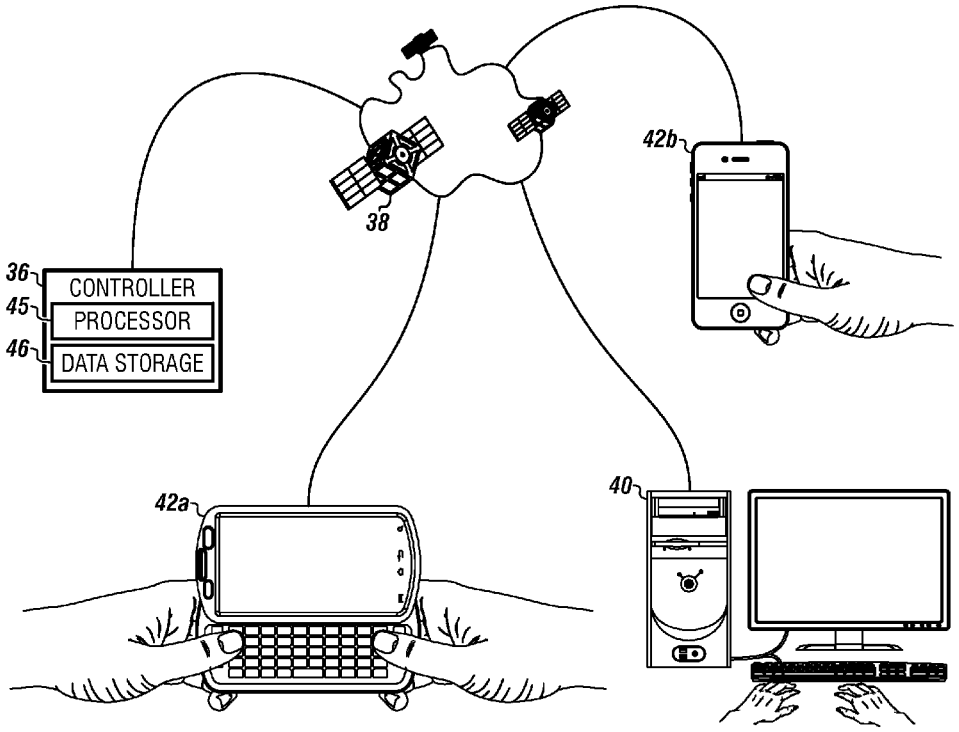
FIG. 2 shows an embodiment of a controller with a processor using computer instructions in a data storage for communicating volatile organic compound concentrations to a network connected to an administrative server and a plurality of client devices according to one or more embodiments.

FIG. 2 shows that in an embodiment, a controller 36 with a processor 45 using computer instructions in the data storage 46 can communicate with at least one network 38, which can be a computing cloud, or a plurality of networks, to a remote administrative server 40, that can be a computer with a processor and a data storage, and a plurality of client devices 42*a* and 42*b* each having a processor, data storage and a display.

The controller 36 can have a processor 45 connected to a data storage 46, and computer instructions for (i) controlled flow of gas and oxygen/air into the shell forming a gas mixture, (ii) controlled ignition of the gas mixture forming an intermediate gas, (iii) temperature control of the intermediate gas, and (iv) controlled neutralization of volatile organic compounds in the intermediate gas forming an emission 32 within 40 CFR part 63 effective 2015.

Figure 3A:
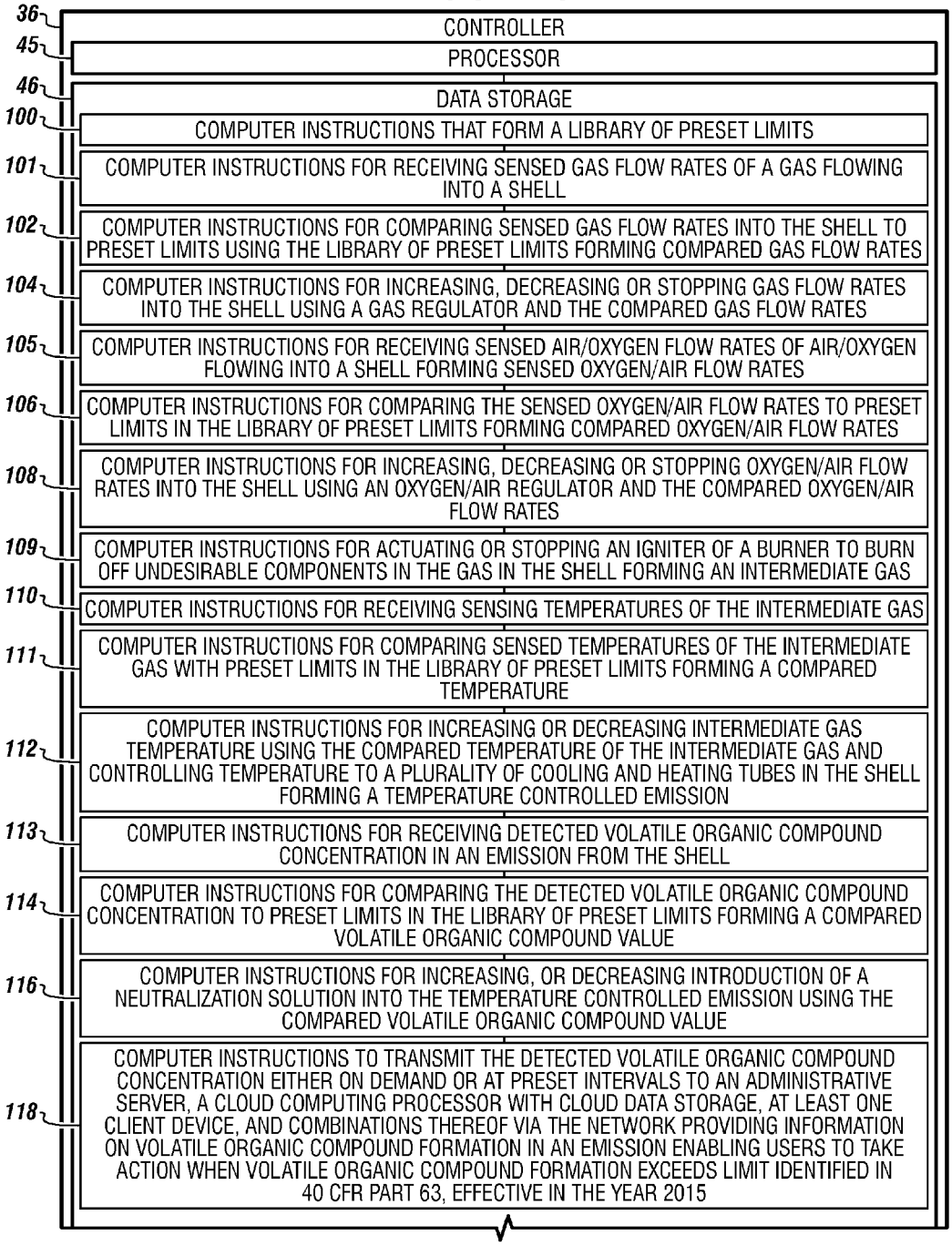
FIGS. 3A and 3B is a diagram of the data storage of the controller and computer instructions used by the controller according to one or more embodiments
Figure 3B:
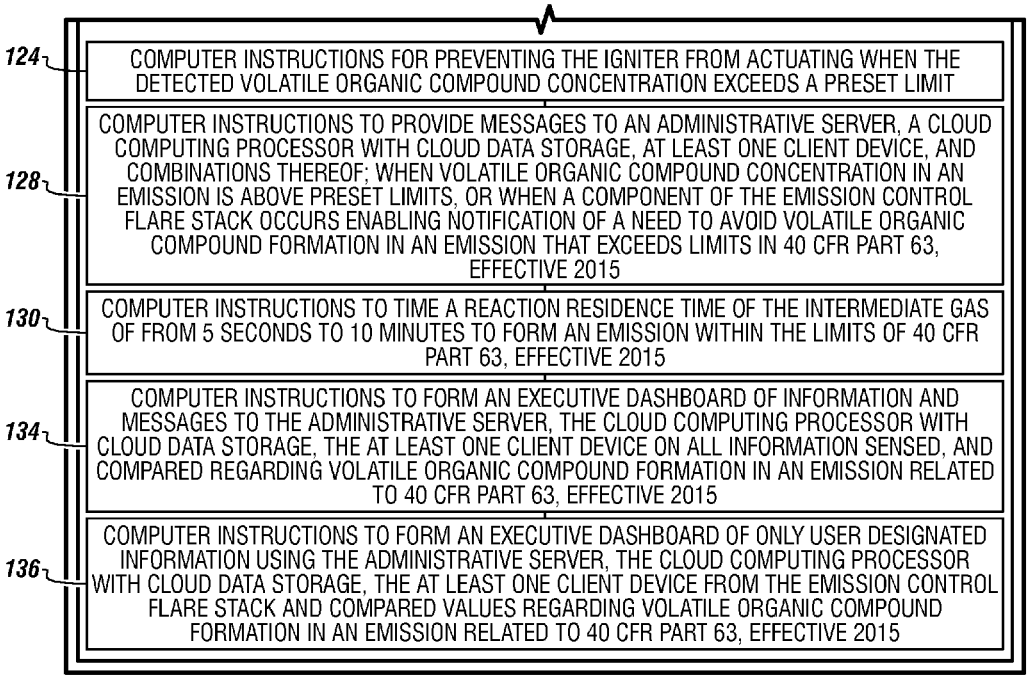

In the data storage can be pluralities of computer instructions which are further depicted in FIGS. 3A and 3B.

The computer instructions in the data storage 46 can be used to sense and control flow rates of gases and oxygen gas mixtures, control burn rates of igniters in a burner, regulate temperature of volatile organic compound emissions; regulate the introduction of a neutralization solution into the volatile organic compound emissions for gases in the emission control flare stack.

In embodiments, the data storage can include computer instructions to automatically compare the signals from the sensors preset temperature, pressure, and volatile organic compound content limits, and adjusts burn rates, oxygen intake, inlet gas intake, and quantities of neutralization solution.

In general, the computer instructions can control flow rates of gases, control flow rates of oxygen gas mixtures, control burn rates of igniters in a burner, regulate temperature in intermediate gases, regulate the introduction of a neutralization solution into the temperature controlled intermediate gases, and monitor volatile organic compound emission from the flare stack transmitting the information to the executive dashboards of the client devices at periodic intervals or continuously.

The controller 36 can include a processor 45 and a data storage 46.

The data storage 46 can include computer instructions that form a library of preset limits 100 which can include tables of gas content, oxygen/air content, temperatures, and neutralization solution content to produce emissions with volatile organic compound content that does not exceed the limits set in the 2015 Code of Federal Regulations effective Jan. 1, 2015 part 63.

The data storage 46 can include computer instructions for receiving sensed gas flow rates of a gas flowing into a shell 101.

The data storage 46 can include computer instructions for comparing sensed gas flow rates into the shell to preset limits using the library of preset limits forming compared gas flow rates 102.

The data storage 46 can include computer instructions for increasing, decreasing or stopping gas flow rates into the shell using a gas regulator and the compared gas flow rates 104.

The data storage 46 can include computer instructions for receiving sensed oxygen/air flow rates of oxygen/air flowing into a shell forming sensed oxygen/air flow rates 105.

The data storage 46 can include computer instructions for comparing the sensed oxygen/air flow rates to preset limits in the library of preset limits forming compared oxygen/air flow rates 106.

The data storage 46 can include computer instructions for increasing, decreasing or stopping oxygen/air flow rates into the shell using an oxygen/air regulator and the compared oxygen/air flow rates 108.

The data storage 46 can include computer instructions for actuating or stopping an igniter of a burner to burn off undesirable components in the gas in the shell forming an intermediate gas 109.

The data storage 46 can include computer instructions for receiving sensing temperatures of the intermediate gas 110.

The data storage 46 can include computer instructions for comparing sensed temperatures of the intermediate gas with preset limits in the library of preset limits forming a compared temperature 111.

The data storage 46 can include computer instructions for increasing or decreasing intermediate gas temperature using the compared temperature of the intermediate gas and controlling temperature to a plurality of cooling and heating tubes in the shell forming a temperature controlled emission 112.

The data storage 46 can include computer instructions for receiving detected volatile organic compound concentration in an emission from the shell 113.

The data storage 46 can include computer instructions for comparing the detected volatile organic compound concentration to preset limits in the library of preset limits forming a compared volatile organic compound value 114.

The data storage 46 can include computer instructions for increasing, or decreasing introduction of a neutralization solution into the temperature controlled emission using the compared volatile organic compound value 116.

The data storage 46 can include computer instructions to transmit the detected volatile organic compound concentration either on demand or at preset intervals to an administrative server, a cloud computing processor and cloud computing data storage, at least one client device, and combinations thereof via the network providing information on volatile organic compound formation in an emission enabling users to take action when volatile organic compound formation exceeds limit identified in 40 CFR part 63, effective in the year 2015 118.

The data storage 46 can include computer instructions for preventing the igniter from actuating when the detected volatile organic compound concentration exceeds a preset limit 124.

The data storage 46 can include computer instructions to provide messages to an administrative server, a cloud computing processor with cloud data storage, at least one client device, and combinations thereof; when volatile organic compound concentration in an emission is above preset limits, or when a component of the emission control flare stack occurs enabling notification of a need to avoid volatile organic compound formation in an emission that exceed limits in 40 CFR part 63, effective 2015 128.

The data storage 46 can include computer instructions to time a reaction residence time of the intermediate gas from 5 seconds to 10 minutes to form an emission within the limits of 40 CFR part 63, effective 2015 130.

The data storage 46 can include computer instructions to form an executive dashboard of information and messages to the administrative server, the cloud computing processor with cloud data storage, the at least one client device on all information sensed, and compared regarding volatile organic compound formation in an emission related to 40 CFR part 63, effective 2015 134.

The data storage 46 can include computer instructions to form an executive dashboard of only user designated information using the administrative server, the cloud computing processor with cloud data storage, the at least one client device from the emission control flare stack and compared values regarding volatile organic compound formation in an emission related to 40 CFR part 63, effective 2015 136.

The information can be detected and compared continuously by the controller and can be continuously provided to an administrative server, a cloud computing processor with cloud data storage, and at least one client device via the network.

Figure 4:
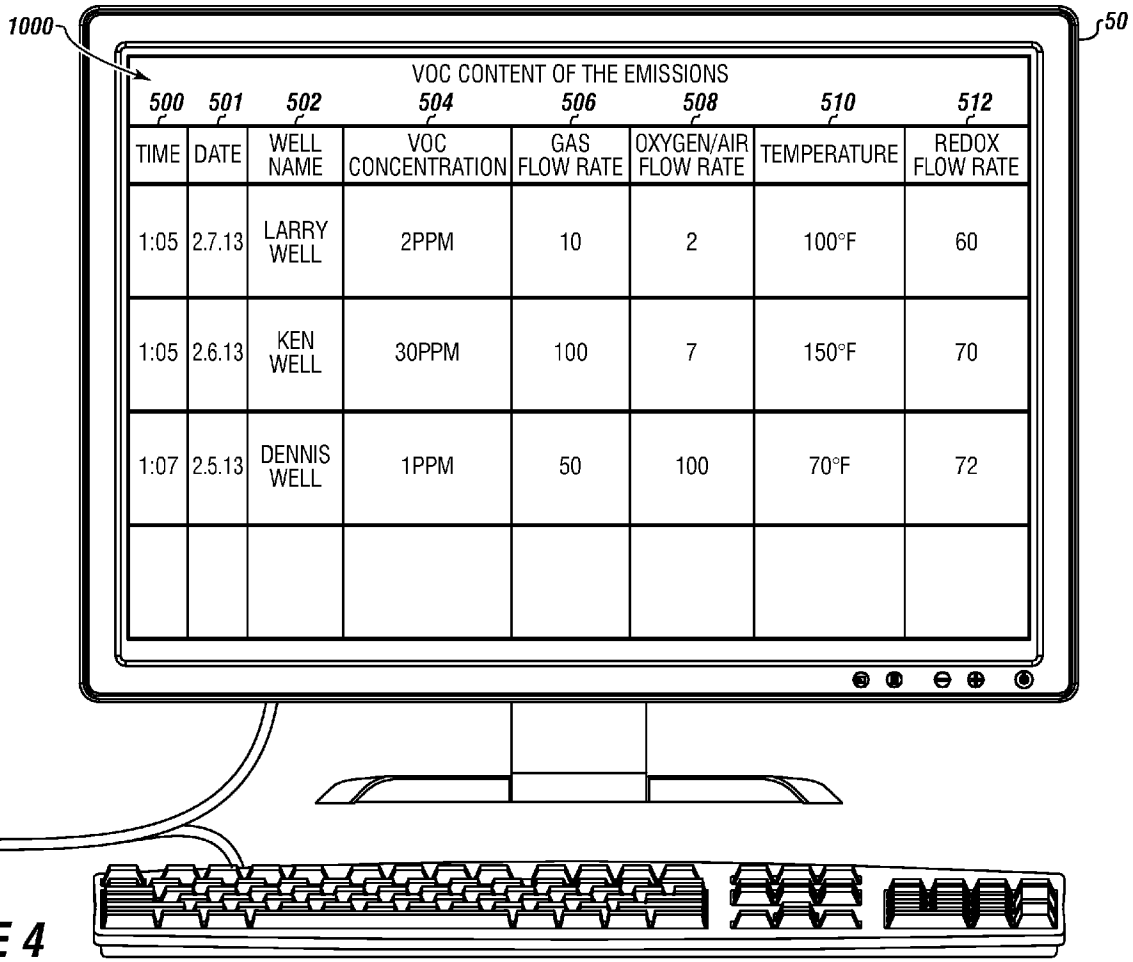
FIG. 4 is a diagram of an executive dashboard of continual monitoring for the controller regarding volatile organic compound content of the emissions according to one or more embodiments.

FIG. 4 is a diagram of an executive dashboard of continual monitoring for the controller regarding volatile organic compound content of the emissions shown on a display 50.

In this executive dashboard 1000, time 500 and date 501 can be viewable along with the well name 502.

For each well, a volatile organic compound concentration 504 is shown, 2 ppm, 30 ppm, and 1 ppm.

Also on the executive dashboard 1000 can be a gas flow rate 506 in cubic feet per minute, shown as 10, 100 and 50, respectively.

The oxygen/air flow rate 508 is also depicted in cubic feet per minute as 2, 7, and 100, respectively.

The temperature 510 of the intermediate gas is shown as 100 degrees Fahrenheit, 150 degrees Fahrenheit and 70 degrees Fahrenheit. The flow rate of the catalytic oxidative-reduction oxygen catalyst, called the catalytic oxidative-reduction oxygen flow rate 512 is also displayed on the dashboard as the controllers determine the rate of 60, 70 and 72.

While these embodiments have been described with emphasis on the embodiments, it should be understood that within the scope of the appended claims, the embodiments might be practiced other than as specifically described herein.

What is claimed is:

1. A computer program product for controlling a formation of volatile organic compounds from gases using an emission control flare stack with a controller having a processor and data storage connected to a network, wherein the emission control flare stack has: a shell with an inlet gas intake and an oxygen/air intake, a gas flow meter connected to the controller, an inlet gas regulator connected to the controller, an oxygen/air flow meter connected to the controller, an oxygen/air regulator connected to the controller, a burner with at least one igniter connected to the controller, a temperature sensor post burner connected to the controller, a plurality of cooling and heating tubes connected to the controller, a neutralization solution regulator connected to the controller, and an emissions sensor connected to the controller, wherein the computer program product comprises:

a. a library of preset limits comprising: tables of gas content, oxygen/air content, temperatures, and neutralization solution content to produce emissions with volatile organic compound content that does not exceed the limits set in the 40 CFR part 63, effective 2015;

b. computer instructions for receiving sensed gas flow rates of a gas flowing into the shell;

c. computer instructions for comparing sensed gas flow rates into the shell to preset limits using the library of preset limits forming compared gas flow rates;

d. computer instructions for increasing, decreasing or stopping gas flow rates into the shell using a gas regulator and the compared gas flow rates;

e. computer instructions for receiving the sensed oxygen/air flow rates of oxygen/air flowing into the shell forming sensed oxygen/air flow rates;

f. computer instructions for comparing the sensed oxygen/air flow rates to preset limits in the library of preset limits forming compared oxygen/air flow rates;

g. computer instructions for increasing, decreasing or stopping oxygen/air flow rates into the shell using an oxygen/air regulator and the compared oxygen/air flow rates;

h. computer instructions for actuating or stopping an igniter of a burner to burn off undesirable components in the gas in the shell forming an intermediate gas;

i. computer instructions for receiving sensing temperatures of the intermediate gas;

j. computer instructions for comparing sensed temperatures of the intermediate gas with preset limits in the library of preset limits forming a compared temperature;

k. computer instructions for increasing or decreasing intermediate gas temperature using the compared temperature of the intermediate gas and controlling temperature to a plurality of cooling and heating tubes in the shell forming a temperature controlled emission;

l. computer instructions for receiving detected volatile organic compound concentration in an emission from the shell;

m. computer instructions for comparing the detected volatile organic compound concentration to preset limits in the library of preset limits forming a compared volatile organic compound value;

n. computer instructions for increasing, or decreasing introduction of a neutralization solution into the temperature controlled emission using the compared volatile organic compound value; and o. computer instructions to transmit the detected volatile organic compound concentration either on demand or at preset intervals to an administrative server, a cloud computing processor and cloud computing data storage, at least one client device, and combinations thereof via the network providing information on volatile organic compound formation in an emission enabling users to take action when volatile organic compound formation exceeds limit identified in 40 CFR part 63, effective 2015.

2. The computer program product of claim 1, wherein the neutralizing solution is injected at a low pressure into the intermediate gas in a flow direction opposite the flow of the intermediate gas.

3. The computer program product of claim 1, wherein cooling and heating of the intermediate gas is by conduction heat exchange.

4. The computer program product of claim 1, wherein the neutralizing solution mists the temperature controlled intermediate gas at a low pressure, wherein the mist is introduced to the temperature controlled intermediate gas in a flow direction opposite to a flow direction of the temperature controlled intermediate gas.

5. The computer program product of claim 4, wherein the mist has a droplet size ranging from 1 micron to 3 microns.

6. The computer program product of claim 5, further comprises using a low pressure from 1 psi to 50 psi to inject the mist into the temperature controlled intermediate gas.

7. The computer program product of claim 1, further comprising computer instructions to time a reaction residence time of the intermediate gas from 5 seconds to 10 minutes to form an emission within the limits of 40 CFR part 63, effective 2015.

8. The computer program product of claim 1, further comprising computer instructions for preventing the igniter from actuating when the detected volatile organic compound concentration exceeds a preset limit.

9. The computer program product of claim 1, further comprising using as the neutralization solution a member of the group comprising: ammonia, urea, and combinations thereof.

10. The computer program product of claim 1, further comprising using as the neutralization solution a catalytic oxidative-reduction oxygen catalyst, comprising a platinum, titanium, or rhodium supported catalyst.

11. The computer program product of claim 1, further comprising computer instructions to provide messages to an administrative server, the cloud computing processor with cloud data storage, at least one client device, and combinations thereof; when volatile organic compound concentration in an emission is above the preset limits, or when a component of the emission control flare stack occurs enabling notification of a need to avoid volatile organic compound formation in an emission that exceed limits in 40 CFR part 63, effective 2015.

12. The computer program product of claim 11, further comprising computer instructions to form an executive dashboard of information and messages to the administrative server, the cloud computing processor with cloud data storage, the at least one client device on all information sensed, and compared regarding volatile organic compound formation in an emission related to 40 CFR part 63, effective 2015.

13. The computer program product of claim 12, further comprising computer instructions to form an executive dashboard of only user designated information using the administrative server, the cloud computing processor with cloud data storage, the at least one client device from the emission control flare stack and compared values regarding volatile organic compound formation in an emission related to 40 CFR part 63, effective 2015.

14. The computer program product of claim 13, wherein the information is detected and compared continuously by the controller and the information is continuously provided to the administrative server, the cloud computing processor and data storage, and at least one client device via the network.

* * * * *